US012146718B2

(12) United States Patent
Uzun et al.

(10) Patent No.: US 12,146,718 B2
(45) Date of Patent: Nov. 19, 2024

(54) INNER CASE FOR HAND GUNS

(71) Applicant: TISAS TRABZON SILAH SANAYI ANONIM SIRKETI, Trabzon (TR)

(72) Inventors: Mustafa Uzun, Trabzon (TR); Hasan Bekçi, Trabzon (TR)

( * ) Notice: Subject to any disclaimer, the term of this patent is extended or adjusted under 35 U.S.C. 154(b) by 0 days.

(21) Appl. No.: 18/245,933

(22) PCT Filed: Nov. 30, 2022

(86) PCT No.: PCT/TR2022/051391
§ 371 (c)(1),
(2) Date: Mar. 20, 2023

(87) PCT Pub. No.: WO2023/059305
PCT Pub. Date: Apr. 13, 2023

(65) Prior Publication Data

US 2024/0353191 A1 Oct. 24, 2024

(30) Foreign Application Priority Data

Dec. 2, 2021 (TR) ..... 2021/018978

(51) Int. Cl.
*F41A 3/66* (2006.01)

(52) U.S. Cl.
CPC ..... *F41A 3/66* (2013.01)

(58) Field of Classification Search
CPC ..... F41A 3/66
USPC ..... 89/196, 195; 42/71.01, 71.02
See application file for complete search history.

(56) References Cited

U.S. PATENT DOCUMENTS

| | | | | |
|---|---|---|---|---|
| 5,669,169 | A | 9/1997 | Schmitter | |
| 6,401,379 | B1 | 6/2002 | Moon | |
| 9,310,160 | B1 | 4/2016 | Dichario | |
| 12,044,494 | B2 * | 7/2024 | Lee | F41A 17/46 |
| 2020/0191514 | A1 | 6/2020 | Lee | |

OTHER PUBLICATIONS

International Search Report for corresponding PCT/TR2022/051391 dated Feb. 27, 2023.
Written Opinion of the International Searching Authority for corresponding PCT/TR2022/051391 dated Feb. 27, 2023.

* cited by examiner

*Primary Examiner* — Reginald S Tillman, Jr.
(74) *Attorney, Agent, or Firm* — Egbert, McDaniel & Swartz, PLLC

(57) ABSTRACT

Disclosed is a case to be placed between the bolt/slide and the gun body/frame in hand guns, with a uniform body made of polymer; a rear support embedded in the polymer body and made of metal; a rear bolt/slide guide provided integrally with the rear support and extending outward from the polymer body; a front support embedded in the polymer body and made of metal; and a rear bolt/slide guide that is provided integrally with the front support and extends outward from the polymer body, and a hand gun of this case.

13 Claims, 3 Drawing Sheets

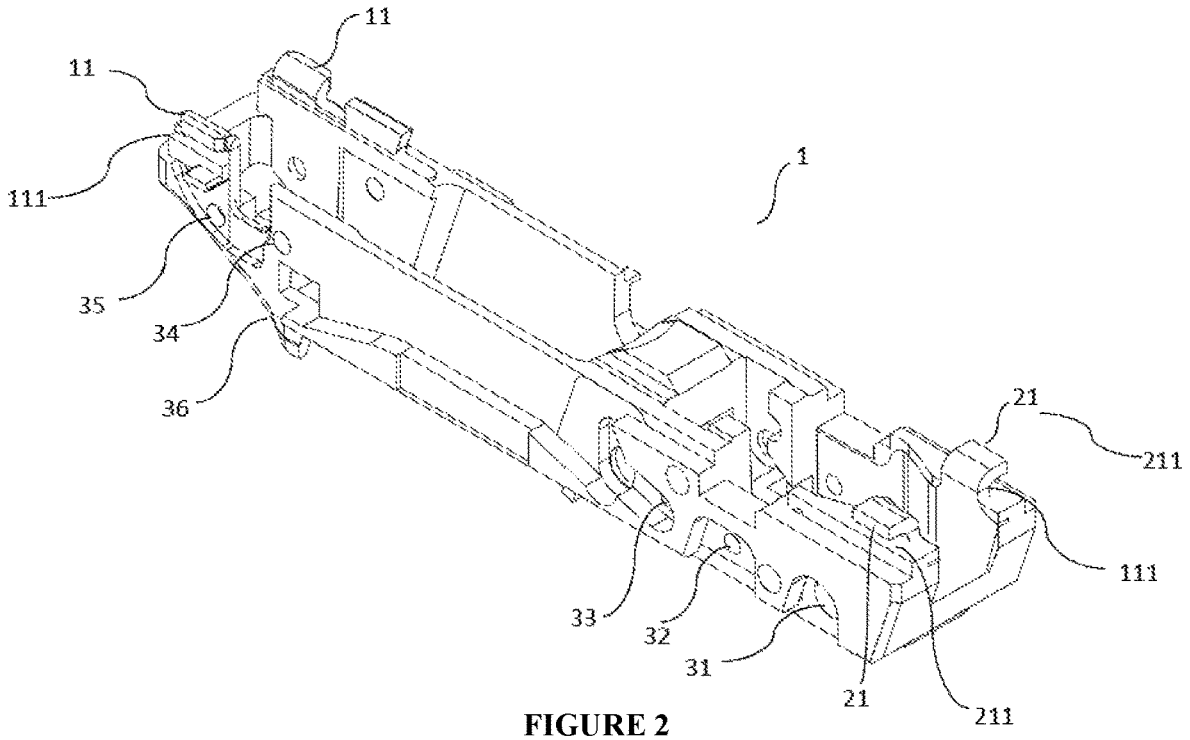
FIGURE 2
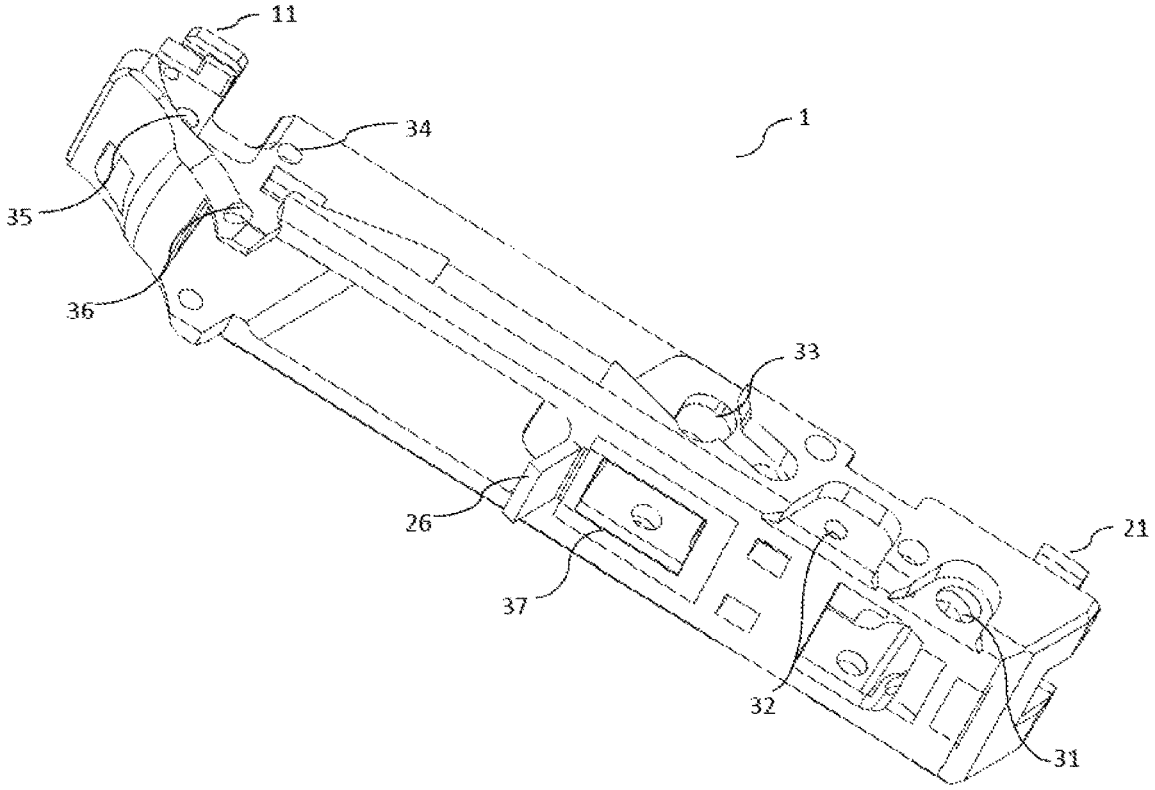
FIGURE 2.A

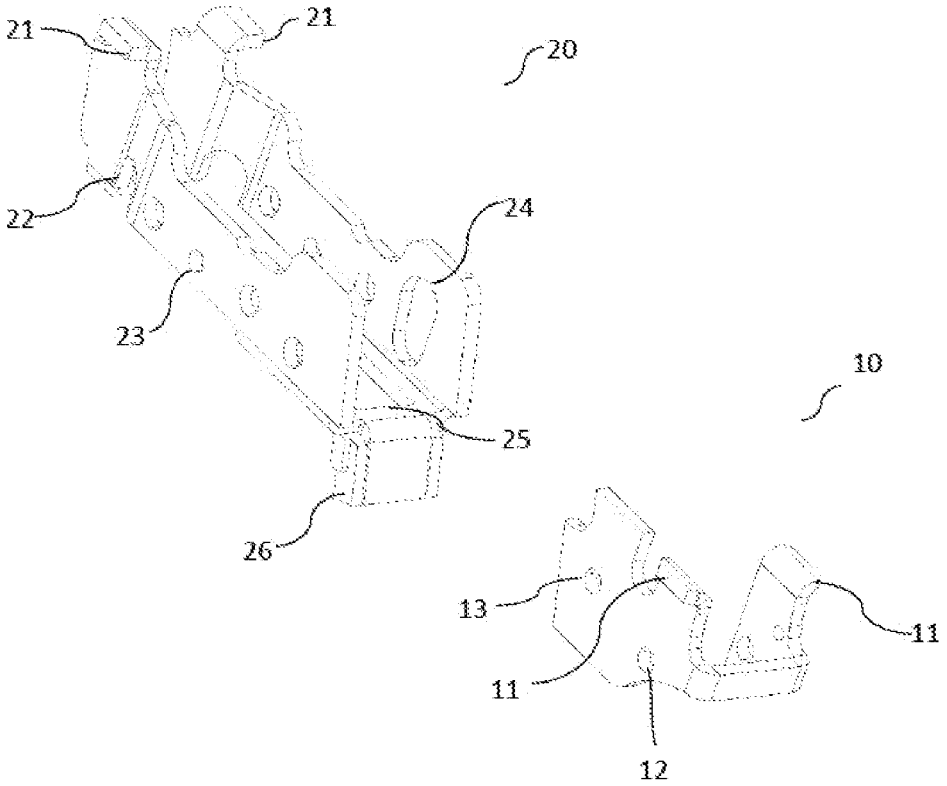
FIGURE 3
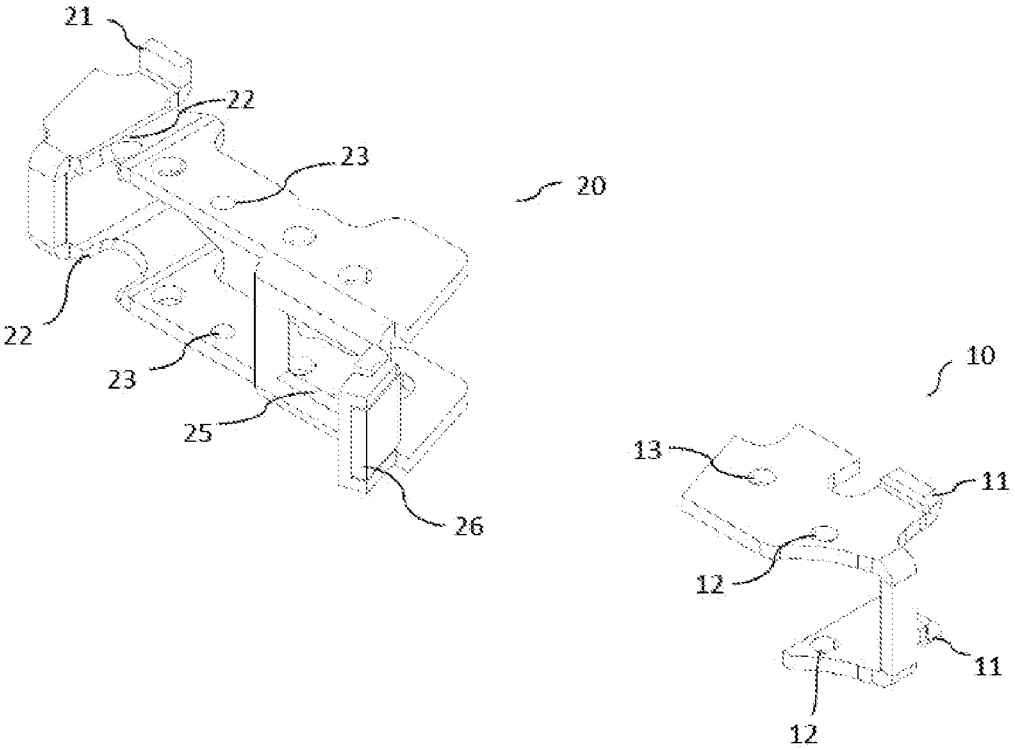
FIGURE 3.A

INNER CASE FOR HAND GUNS

TECHNICAL FIELD

The invention is related to an inner case provided between the gun body/frame and the bolt/slide of hand guns and in which various mechanisms are mounted.

BACKGROUND

Guns can be manufactured from steel, aluminum, polymer, or composite materials. In guns, the frame set is located in the body/frame of the gun. Gun bodies/frames can be manufactured from steel, aluminum, or polymers. The bodies/frames made of steel and aluminum can show sufficient strength for the frame set and the bolt set to work in harmony. Gun bodies/frames made of polymer cannot show sufficient strength to fulfill this task. Therefore, polymer case bodies/frames are supported by a component made from steel, called casing.

In the document with publication number U.S. Pat. No. 9,310,160B1, a metal polymer hybrid gun is disclosed. Here, the term hybrid refers to a polymeric gun body/frame and a metallic case placed inside the said gun body/frame. Holes for mounting various mechanisms of the gun are provided on the metallic body/frame.

In the production of steel parts, called the case, which is used to support polymer bodies/frames, there are long-term and narrow tolerance machining processes, and therefore the cost is high. In addition, meeting tolerances and performing the verification of the finished product are also challenging. In the metal injection molding (MIM) method, which is another method of producing cases from steel material, there are problems such as getting the casting cavities or tolerances right.

As a result, all the above-mentioned problems have made it necessary to make an innovation in the related technical field.

OBJECT OF THE INVENTION

The present invention aims to eliminate the above-mentioned problems and to make a technical innovation in the related field.

The main object of the invention is to present an inner case structure that can provide the required endurance values for hand guns more lightly and inexpensively, and which is faster and simpler than alternative systems in the production process.

BRIEF DESCRIPTION OF THE INVENTION

In order to realize all the above-mentioned objectives and the ones which will emerge from the detailed description below, the present invention is a case to be placed between the gun body/frame and the bolt/slide in the hand guns. Accordingly, the present invention comprises a uniform body/frame made of polymer; a metal rear support embedded in the said polymer body/frame; a rear bolt/slide guide provided integrally with the said rear support and extending outward from the polymer body/frame, and a front support made of metal and embedded in the said polymer body/frame; a rear bolt/slide guide which is integrally provided with the said front support and extends outward from the polymer body/frame.

Thereby, the use of metal in the case is reduced, especially the weight is reduced, and additionally, by forming the rear and front bolt/slide guides outside of the body/frame, the wearing on the body/frame with the contact of the bolt/slide was prevented, and the use of the polymer metal case was rendered long-term and applicable.

In a preferred embodiment of the invention, the said body/frame case comprises a barrel lock opening and the said front support comprises a barrel lock opening concentric with the case barrel lock opening.

In another preferred embodiment of the invention, the said body/frame case comprises a body/frame connection opening and the said front support comprises a body/frame connection opening concentric with the front support case body/frame connection opening.

In a preferred embodiment of the invention, the said body/frame comprises the case trigger connection opening and the said front support comprises a trigger connection opening concentric with the case trigger connection opening.

In another preferred embodiment of the invention, the said body/frame comprises a case hammer connection opening and the said rear support comprises a hammer connection opening concentric with a case hammer connection opening.

In a preferred embodiment of the invention, the said body/frame comprises a case latch connection opening, and the said rear support comprises a latch connection opening concentric with the case latch connection opening.

In another preferred embodiment of the invention, the said rear support comprises an abutment extension to abut the gun body/frame.

In a preferred embodiment of the invention, the said rear support is uniform.

In a preferred embodiment of the invention, the said front support is uniform.

In another preferred embodiment of the invention, the said front and rear supports are provided not to contact each other.

Another preferred embodiment of the invention comprises rear channels provided between the said rear bolt/slide opening and the body/frame, and front channels provided between the front bolt/slide guide and the body/frame.

In order to realize all the above-mentioned objectives and the ones which will emerge from the detailed description below, the present invention comprises a gun body/frame having a handle and a case body for the user to grasp; case in accordance with any one of the embodiments outlined in claims 1-11 or as will emerge from the detailed description placed in the said case body, and a bolt/slide placed within the rear and front bolt/slide guides of the said case.

Thereby, a hand gun that is much lighter but much more durable has been produced, and accordingly, it can withstand much faster bullet exit velocities as well as being easy to carry.

In order to realize all the above-mentioned objectives and the ones which will emerge from the detailed description below, the present invention is a production method of a case to be placed between the bolt/slide and the gun body/frame in hand guns. Accordingly, the present method comprises the steps of providing rear and front support made of metal and comprising a front bolt/slide guide and a rear bolt/slide guide, respectively; providing a body/frame with a polymer injection method that will trap the said front and rear support in such a way that only the front bolt/slide guide and rear bolt/slide guides are left out.

Thereby, case production is made possible with a production method that allows working with much higher tolerances.

BRIEF DESCRIPTION OF THE FIGURES

FIG. 2 shows the isometric view of the case of the invention.

FIG. 2.A shows another isometric view of the case of the invention.

FIG. 3 shows the isometric view of the front and rear support.

FIG. 3.A shows another isometric view of the front and rear support.

Drawings do not necessarily need to be scaled and details that are not necessary for understanding the present invention may be omitted. Furthermore, elements that are at least substantially identical or have at least substantially identical functions are denoted by the same number.

DESCRIPTION OF THE REFERENCE NUMERALS IN THE FIGS

Figure 1:
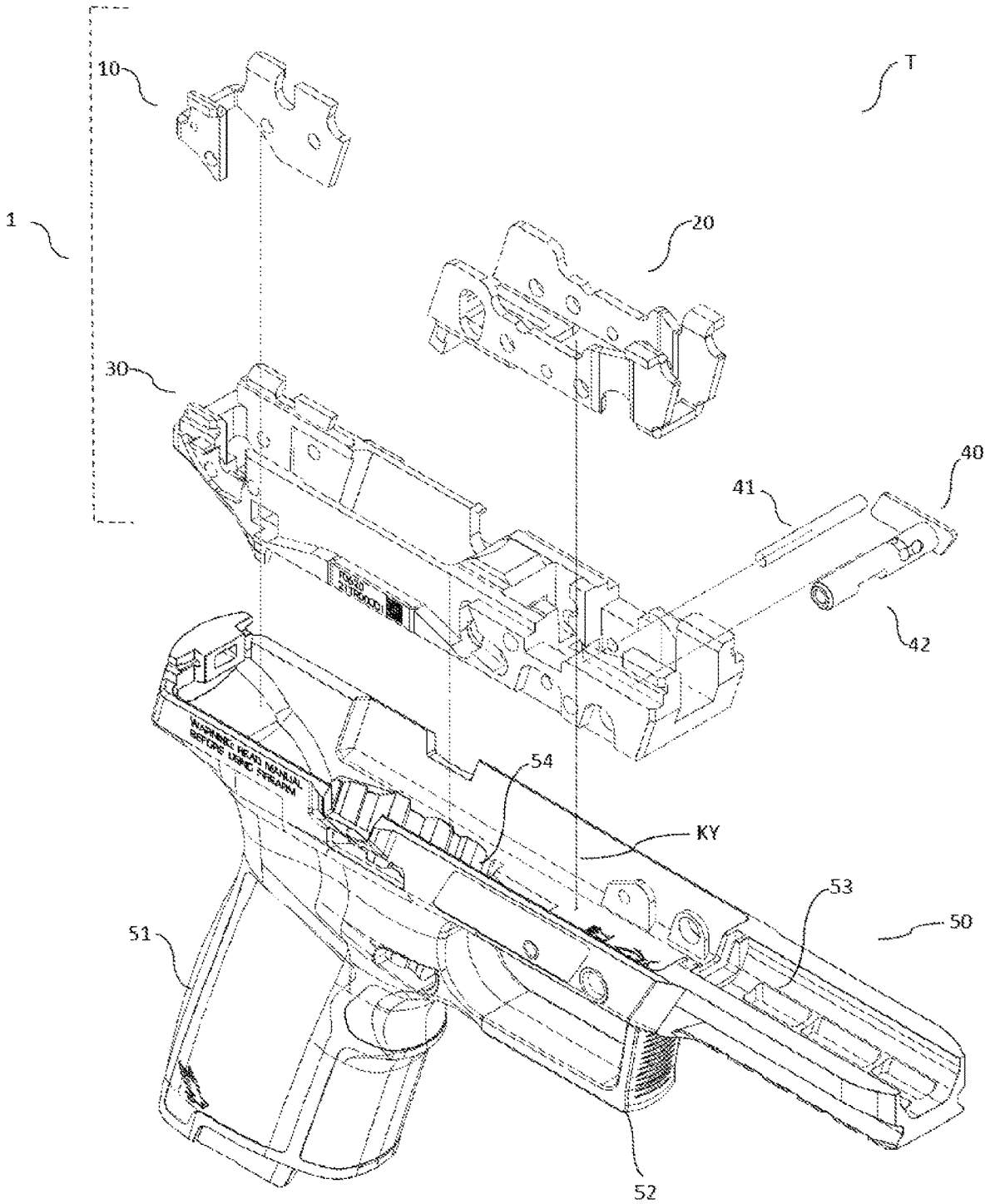
FIG. 1 shows the exploded isometric view of the hand gun of the invention.

1. Case
- 10. Rear support
  - 11. Rear bolt/slide guide
    - 111. Rear channel
  - 12. Latch connection opening
  - 13. Hammer connection opening
- 20. Front support
  - 21. Front bolt/slide guide
    - 211. Front channel
  - 22. Barrel lock opening
  - 23. Case connection opening
  - 24. Trigger connection opening
  - 25. Base opening
  - 26. Abutment extension
- 30. Body
  - 31. Case barrel lock opening
  - 32. Case body connection opening
  - 33. Case trigger connection opening
  - 34. Case hammer connection opening
  - 35. Case latch connection opening
  - 36. Hammer spring connection opening
  - 37. Case base opening
- 40. Connection pins
  - 41. Case connection pin
  - 42. Barrel connection pin
- 50. Gun body/frame
  - 51. Handle
  - 52. Trigger guard
  - 53. Barrel part
  - 54. Support surface
- T. Hand gun
- KY. Case housing

DETAILED DESCRIPTION OF THE INVENTION

In this detailed description, an inner case (1) for the hand gun (T) of the invention is only explained with examples that will not create any limiting effect so that the subject can be better understood.

The subject of the invention is related to an inner case (1) provided between the gun body body/frame (50) and the bolt/slide (not shown in the figures) of hand guns (T), in which various mechanisms are mounted.

Referring to FIG. 1; the hand gun (T) of the invention comprises a gun body/frame (50) having a barrel part (53) extending in a barrel axis and a handle (51) angled relative to the barrel axis for the user to grasp. An arc-shaped trigger guard (52) is arranged at the junction of the said handle (51) and the barrel part (53). The said gun body/frame (10) can be made of many different materials such as metal, polymer, composite, or it can be provided in a hybrid structure containing at least two of the mentioned materials. Since the hand gun (T) of the invention is reinforced with a case (1) inside, it can preferably be provided with a polymer body/frame.

The said hand gun (T) can only have a pinned, hammer, or hammer-pinned firing mechanism. If the hammer and hammer-pinned systems are selected, accordingly they contain at least one hammer (not shown in the figures). The said hammer detonates the ammunition capsule directly or indirectly (via a pin) with the drive provided by the trigger (not shown in the figures).

The inner case (1) of the hand gun (T) consists of three basic parts, namely the rear support (10) and the front support (20), and the body (30). The rear support (10) and front support (20) and the body (30) mentioned here are shown separately for a better understanding of the invention, and in the invention, the rear and front supports (10, 20) are provided embedded in the body (30) as in FIG. 2.

The inner case (1) is placed in the case housing (KY) provided on the gun body/frame (50) and is then fixed in the case housing (KY) by means of the connecting pins (40) passing through the holes provided on the same and the gun body/frame (50). The said connection pins (40) can be provided as the case connection pin (41) that connects the case (1) with the gun body/frame (50) and/or the barrel connection pin (42) that fixes the barrel to the case (1) and the gun body/frame (50).

With reference to FIGS. 2 and 2.A; in the said inner case (1), the rear and front cases (10, 20) are made of metallic material, for example, steel or aluminum, and the body (30) is made of polymer. The rear and front cases (10, 20) mentioned here are provided as embedded in the case (30) apart from the front and rear bolt/slide rails (11, 21), respectively.

The front and rear bolt/slide bolts/slides (11, 21) are the part where the movable upper bolt/slide (not shown in the figures) part of the hand gun is placed. The front and rear bolts/slides (11, 21) form the rear and front channels (111, 211), respectively, and the bolt/slide can move back and forth linearly on the channel axis by being seated in these channels. Here, the channels can be formed directly on the front and rear bolt/slide rails (11, 21).

Many openings and holes can be found in the inner case (1) for mounting the firing mechanisms of the hand gun (T). As the whole mechanism can be mounted on the case (1), some mechanical elements can also be mounted on the gun body/frame (50). Some of the mounting openings to be described here may be absent in some embodiments of the case (1). Mounting openings that are not present in such embodiments may be provided on the gun body/frame (50) or may not be present on the hand gun (T) if not needed.

There is a barrel opening (31) on the said body (30) where the barrel connection pin (42) can be placed in order to connect the barrel to the case (1). In addition, there is a case body/frame opening (50) that allows the connection pin (41) of the case to pass through and fix the case (1) to the gun body/frame (50). In addition, on the body (30), the case trigger connection opening (33), the case hammer connection opening (34), and the case latch connection opening (34) for connecting the trigger, hammer, and latch to the case (1), respectively, and a hammer spring opening for the connection of the hammer spring (36) has been formed. The distribution of the said openings in the figures only shows an embodiment of the invention and can be provided completely differently from the configuration of the hand gun (T).

With reference to FIGS. 3 and 3.A; the said rear and front support (30) are made of metal. The said rear support (20) comprises two opposing surfaces parallel to each other and an extension connecting these two surfaces, and the said extension remains on the rear part of the body (30).

The said rear support (10) and front support (20) are two discrete metal parts that are not connected, placed at points that will increase the strength specifically.

The front support (30), on the other hand, comprises two opposing surfaces parallel to each other and an extension connecting these two surfaces, and the said extension remains on the part of the body (30) facing the barrel side.

In addition, there is a base opening (25) between the two surfaces mentioned, where another surface is provided. The base opening (25) is provided by opening a certain area on the surface, and in order to open the area, the part is bent into the gun body/frame (50) to form a support extension (26). The said abutment extension (26) sits on a support surface (54) formed on the case housing (KY) and provides a support point for the case (1). The said abutment extension (26) extends through the case base opening (37) provided on the body (30).

The said rear support (10) and front support (10) contain mounting openings as with the body (30). If the mounting openings provided on the body (30) are provided in the parts where the rear or front support (10, 20) is located, there may be mounting openings corresponding to the said mounting openings on the surface of the rear or front support (10, 20) concentrically. In addition, the positions of the openings on the rear and front supports (10, 20) shown in the figures are the points where the case (1) has the most difficulty in terms of endurance, therefore, the relevant metal rear and front supports (10, 20) are placed at these points.

A latch connection opening (12) is provided on the rear support (10) so that the latch can pivotally connect via a pin. In order to ensure harmony between the mounting openings mentioned above, the latch connection opening (12) is provided concentrically with the case latch connection opening (35), and the pin connecting the latch passes through both the latch connection opening (12) and the case latch connection opening (35).

A hammer connection opening (13) is provided on the rear support (10) so that the hammer can be rotated through a pin. In order to ensure the harmony between the above-mentioned mounting openings, the hammer connection opening (13) is provided concentrically with the case hammer connection opening (34) and the pin connecting the hammer passes both through the hammer connection opening (13) and the case hammer connection opening (34).

A barrel lock opening (22) is provided on the front support (20) so that the barrel can be securely connected to the case (1) via the barrel connection pin (41). In order to ensure harmony between the above-mentioned mounting openings, the barrel lock opening (22) is provided concentrically with the case barrel connection opening (31) and the pin connecting the barrel passes through both the barrel lock opening (13) and the case barrel connection opening (31).

A case connection opening (23) is provided on the front support (20) so that the case (1) can be securely connected to the gun body/frame (50) via the case connection pin (41). In order to ensure harmony between the above-mentioned mounting openings, the case connection opening (23) is provided concentrically with the case body connection opening (32) and the pin connecting the case (1) passes through both the case connection opening (23) and the case body connection opening (32).

A trigger connection opening (24) is provided on the front support (20) so that the trigger can be rotated via a pin. In order to ensure harmony between the mounting openings mentioned above, the trigger connection opening (24) is provided concentrically with the case trigger connection opening (33) and the pin connecting the trigger passes through both the trigger connection opening (24) and the case trigger connection opening (33).

The case (1) of the invention is preferably produced in such a way that its tolerance values are based on the polymer injection method, which gives much more stable results in terms of tolerance in mass production.

First, the rear and front support pieces (10, 20) suitable for any of the above-described embodiments are produced by the sheet molding process and then preferably subjected to the finishing process, preferably using CNC benches. Since the entire case (1) was dependent on machining in the prior art, although this process is not eliminated, the area to be applied has been narrowed, making the process much easier.

Then, the rear and front support (10, 20) parts obtained are placed in the mold that will provide the body (30), and then the heated polymer molds are pressed. Here, the molds are configured so that the polymer does not reach the parts where the rear and front bolt/slide guides (11, 21) are located. The resulting case (1) is then removed from the mold. Here, except for the rear and front bolt/slide guides (11, 21), all the rear and front supports (10, 20) are embedded in the polymer body (30). The said mold is also arranged to form a surface under the rear and front bolt/slide guides (11, 21) to form the rear and front channels (111, 211).

The protection scope of the invention is given in the attached claims, and it cannot be limited to what has been described as an example in this detailed description under any circumstances. It is understood that a person with the skill in the related technique can put forth similar embodiments in the light of what has been described above, without departing from the main theme of the invention.

The invention claimed is:

1. A case to be placed between a bolt/slide and a gun body/frame in hand guns, wherein the case comprises:

a uniform body made of polymer;

a rear support embedded within said uniform body and made of metal;

a rear bolt guide which is provided integrally with said rear support and extends outward from the uniform body;

a front support embedded within said uniform body and made of metal; and a rear bolt/slide guide which is provided integrally with said front support and extends outward from the uniform body.

2. A case according to claim 1, wherein said uniform body comprises a case barrel lock opening and said front support comprises a barrel lock opening concentric with the case barrel lock opening.

3. A case according to claim 1, wherein the uniform body comprises a case body connection opening and said front support comprises a case connection opening concentric with the case body connection opening.

4. A case according to claim 1, wherein said uniform body comprises a case trigger connection opening and said front support comprises a trigger connection opening concentric with the case trigger connection opening.

5. A case according to claim 1, wherein said uniform body comprises a case hammer connection opening and said rear support comprises a hammer connection opening concentric with the case hammer connection opening.

6. A case according to claim 1, wherein said uniform body comprises a case latch connection opening and said rear support comprises a latch connection opening concentric with the case latch connection opening.

7. A case according to claim 1, wherein said rear support comprises an abutment extension to abut the gun body/frame.

8. A case (H) according to claim 1, wherein said rear support is uniform.

9. A case according to claim 1, wherein said front support is uniform.

10. A case according to claim 1, wherein said front and rear supports are provided not to contact each other.

11. A case according to claim 1, wherein rear channels provided between said rear bolt/slide guide and said uniform body and front channels provided between said front bolt/slide guide and said uniform body.

12. A hand gun, comprising a gun body/frame having a handle and a case housing for the user to grasp; a case placed in the said case housing according to claim 1, and a bolt/slide inserted into a rear and front bolt/slide guides of said case (1).

13. The production method of a case (1) to be placed between a bolt/slide and a gun body/frame in hand guns, comprising;

a) providing a rear and front support made of metal and comprising a rear bolt/slide guide and a front bolt/slide guide, respectively; and b) applying a body that will trap said front and rear support in such a way that only the rear bolt/slide guide and front bolt/slide guide will remain outside, on the front and rear support by polymer injection method.

* * * * *